US006603087B2

(12) United States Patent
Österholm et al.

(10) Patent No.: US 6,603,087 B2
(45) Date of Patent: Aug. 5, 2003

(54) SWITCH-DISCONNECTOR CONTROL UNIT

(75) Inventors: Nils Österholm, Vaasa (FI); Per-Erik Östersund, Sundom (FI)

(73) Assignee: ABB Technology Ltd., Zurich (CH)

( * ) Notice: Subject to any disclaimer, the term of this patent is extended or adjusted under 35 U.S.C. 154(b) by 58 days.

(21) Appl. No.: 09/985,641

(22) Filed: Nov. 5, 2001

(65) Prior Publication Data

US 2003/0034330 A1 Feb. 20, 2003

(30) Foreign Application Priority Data

Nov. 8, 2000 (FI) ..... 20002450

(51) Int. Cl.[7] ..... H01H 33/12

(52) U.S. Cl. ..... 218/12; 335/68; 335/76; 335/77

(58) Field of Search ..... 335/167–176, 335/68, 76, 77; 218/11–14, 71, 78, 84, 92, 153, 154; 200/400–401

(56) References Cited

U.S. PATENT DOCUMENTS 4,103,133 A * 7/1978 Erickson et al. ..... 218/12
5,739,489 A * 4/1998 Marmonier et al. ..... 200/50.32
6,015,959 A * 1/2000 Slepian et al. ..... 200/400
6,400,244 B1 * 6/2002 Bergamo et al. ..... 335/195

FOREIGN PATENT DOCUMENTS

FI 79420 8/1989

* cited by examiner

*Primary Examiner*—Lincoln Donovan
(74) *Attorney, Agent, or Firm*—Dykema Gossett PLLC

(57) ABSTRACT

A switch-disconnector control unit comprising an electromagnet as an actuator including a moving control arm, and a spring actuator including a control shaft. The control arm is controlled by an armature of the actuator and connected to the control shaft. Said control shaft is arranged to control the contacts of the switch-disconnector using the spring actuator. The control arm comprises a connection element, which is jointedly connected through a control element to the control shaft and the actuator. An articulated joint at the end of said connection element is formed of an oval opening and a pin. Said opening is shaped as an ellipse in the longitudinal direction of the connection element, and is dimensioned to form a clearance in the joint between the connection element and the control arm of the actuator.

13 Claims, 5 Drawing Sheets

SWITCH-DISCONNECTOR CONTROL UNIT

FIELD OF THE INVENTION

The invention relates to a switch-disconnector control unit. A switch-disconnector is used to form a safe clearance between an electric circuit to be disconnected and other electric circuits, or it is used to de-energize a part of the electric circuit in order to assure the safety of the work.

BACKGROUND OF THE INVENTION

Switch-disconnectors are used in electricity distribution networks. A switch-disconnector is used to form a safe clearance between an electric circuit to be disconnected and other electric circuits, or it is used to de-energize a part of the electric circuit in order to assure the safety of the work. For this purpose, the switch-connector is arranged to be controlled between three switching positions. These positions are: disconnector closed, disconnector open and disconnector earthed. In the close position, the disconnector connects an electric circuit disconnected by means of said disconnector to another electric circuit. In the open position, the disconnector disconnects the electric circuit disconnected using said disconnector from another electric circuit. In the earthed position, the disconnector earths the electric circuit disconnected using said disconnector to be de-energized in order to assure the safety of the work.

Manually operated switch-disconnector control units are previously known in the art that are controlled using a crank connected to the control shaft of the disconnector. This requires the presence of a physical person to control the procedure, who carries out the control in the immediate vicinity of the switch-disconnector. It is also known to use remote-controlled control units provided with a motorized actuator that can be controlled either manually or using remote control for controlling the disconnector. These disconnector control units comprise a spring actuator connected to the control shaft of the disconnector. The spring in the spring actuator is tightened using a motorized actuator. When the motorized actuator has rotated the control shaft to the tripping point of the spring, the spring trips and provides an adequate amount of strength to open or close the contact of the switch-disconnector.

Control units for bistable switch-disconnectors are also previously known in the art. In such a case, the positions concerned are close and open. Newer types of switch-disconnectors also comprise an earth switch integrated to the switch-disconnector and a spring actuator. Thus, the spring actuator comprises three positions: open, close and earthed. The spring actuator may alternatively be provided with two control shafts or two control points in order to switch said actuator between the open and close positions and between the open and earthed positions. Such a conventional switch-disconnector provided with an earth switch comprises a manual control unit and a motor-operated control unit, which opens and closes the main circuit of the switch-disconnector. Said switch-disconnector further comprises a separate manually operated control unit, which opens and closes a separate or integrated earth switch. In addition, one or more very complicated blocking mechanisms are required to prevent malfunctions, such as the simultaneous closing of the switch-disconnector and the earth switch. The structure of such a switch-disconnector control unit is very complex and liable to malfunction, as it comprises a plurality of separate structural parts, wherefore it is also expensive to implement.

A general requirement for a switch-disconnector is that switching between open and earthed positions can only be carried out manually and the switching between open and closed positions can be performed both manually and using remote-control.

Significant drawbacks are thus associated with the prior art. The prior art switch-disconnector control units described above are manually operated or motor-operated if they are remote controlled, whereby the structures thereof are complicated and liable to malfunction and as regards the switching speed very slow. What is also essential is that remote control to the earthed position is prevented, which requires very complex blocking mechanisms in the prior art solutions.

BRIEF DESCRIPTION OF THE INVENTION

It is an object of the present invention to eliminate the drawbacks of the prior art and to provide an improved solution for a switch-disconnector control unit and to provide a switch-disconnector control unit comprising a single control shaft that enables to switch the switch-disconnector between the open and close (OPEN-CLOSE) positions and between the open and earthed (OPEN-EARTHED) positions. Switching between the open and close positions (OPEN-CLOSE) is carried out manually by turning the control crank connected to the control shaft of the disconnector or by means of remote control (an automatic actuator) by turning the control shaft of the disconnector. Switching between the open and earthed positions (OPEN-EARTHED) can only be carried out manually by turning the control crank of the disconnector. In addition the control motion provided by the remote-controlled actuator between the open and close positions (OPEN-CLOSE) and vice versa is fast and strong, but the actuator does not, however, prevent the manual control of the switch-disconnector.

This is achieved with a switch-disconnector control unit provided with the characteristics defined in the claims in accordance with this invention. The switch-disconnector control unit comprises an actuator including a moving control member and a spring actuator including a control shaft, whereby the control member is connected from the first end thereof to the actuator and from the second end thereof to the control shaft of the spring actuator, whereby the control shaft is arranged to control the contacts of the switch-disconnector using the spring actuator, and the invention is characterized in that the control member comprises a connection element, which connection element is jointedly connected from the first end thereof to the control shaft through a control member, and from the second end thereof the connection element is jointedly connected to the control member of the actuator, and an articulated joint at the second end of the connection element is substantially formed of an opening parallel to the control shaft in the vicinity of the end of the connection element and of a pin parallel to the control shaft connected to the control member of the actuator substantially in the vicinity of the end of the connection element side thereof, the pin being arranged to the opening, which is dimensioned to be large in relation to the pin.

In other words, the actuator in the control unit comprises an electromagnet, the armature of which linearly moves the control arm, which is connected from the first end thereof to the control shaft controlling the contacts of the switch-disconnector using the spring actuator through the control member and from the second end thereof to the armature of the electromagnet. The control member comprises a connection element, which is jointedly connected from the first end thereof to the control shaft and from the second end thereof jointedly connected to an arm part connected to the armature of the electromagnet. The articulated joint at the second end of the connection element, or at the armature end, is substantially formed of a preferably oval opening parallel to the control shaft the end of the connection element and of a pin parallel to the control shaft connected to the arm part in the vicinity of the to the control shaft connected to the arm part in the vicinity of the end of the connection element thereof, and said arm part being connected to the armature of the electromagnet, and the pin is arranged to said oval opening.

The preferred embodiments of the invention are disclosed in the dependent claims.

In the solution of the invention the oval opening at the end of the actuator in the connection element connected to the control member moving the control shaft preferably resembles an ellipse in the longitudinal direction of the connection element. The opening is dimensioned to form a clearance in the joint between the connection element and the control member of the actuator. Such a connecting way that allows a particular clearance in the joint allows turning the control shaft of the disconnector manually into a position, where the control member controlling the control shaft to which the connection element is jointedly connected, can revolve over the dead centre thereof to the other side of the control shaft and further to such a point where the switch into the earthed position occurs. When placed into the earthed position, the actuator cannot turn the control shaft so that the disconnector is able to be directed back over the dead centre to the open position using the remote-control of the actuator, whereby such an advantage is achieved that the remote-controlled malfunctions cannot occur and the safety of the disconnector improves. Switching from the earthed position to the open position must therefore be carried out manually.

In accordance with a preferred embodiment, the articulated joint at the end of the connection element on the side of the spring actuator is substantially formed of an opening in the vicinity of the end of the connection element and of a pin parallel to the control shaft connected to the control member of the control shaft in the spring actuator, the pin being arranged into the opening, which is dimensioned to be large in relation to the pin. The shape of the opening is preferably oval.

The actuator controlling the disconnector is preferably an electromagnet, the armature of which controls the control member, which moves the control shaft of the disconnector. The electromagnet is double-acting, meaning that the armature thereof moves linearly back and forth by means of the electric control. Consequently the electromagnet is able to direct the disconnector to both the open and close positions. The control shaft of the disconnector control unit is arranged to control the contacts of the switch-disconnector through the spring actuator. This spring actuator comprises one or more springs to be tightened using the motion of the electromagnet armature, in which case the spring of the spring actuator trips substantially at the end point of the armature motion, thus opening or closing the contacts of the switch-disconnector.

The disconnector control unit according to the invention, in which an electromagnet functions as the actuator, is capable of controlling the disconnector by means of remote control in the same way as the motorized actuator and also allows controlling the disconnector manually. In comparison with the motorized actuator the electromagnet actuator provides such an advantage that the structure of the electromagnet actuator is significantly simpler and it performs the control operations and sequences considerably faster than the motorized actuator. The magnet actuator also provides such an advantage that the electromagnet armature moves quite freely, while the electromagnet coils are de-energized, without hindering the manual control of the disconnector. Furthermore, the strength curve of the electromagnet actuator is highly suitable to tighten the springs of the spring actuator, since the strength increases towards the end part of the armature motion as the strength required for tuning the spring.

Moreover, in comparison with the previously known disconnector control units provided with magnet actuators, in the double-acting switch-disconnector said magnet control unit can be connected to the switch-disconnector, whereby the mechanism of the invention allows switching the disconnector to all three positions, i.e. open, close and earthed, as required.

The solution of the invention thus provides the following significant advantages:

1. The switching of the switch-disconnector to open and close positions (OPEN-CLOSE) can be carried out both automatically using electrical control and manually.
2. The length of stroke and the strength curve of the electromagnet can preferably and efficiently be utilized.
3. The switch between the open and earthed positions in the switch-disconnector can only be carried out manually. Even though the control voltage of the magnet actuator is switched in the earthed position, the magnet actuator provided with the mechanism of the invention cannot direct the disconnector from the earthed position and no separate protection mechanisms are required, and no mechanical disconnection mechanism is required between the control shaft and the electromagnet armature for opening and closing the earthed position.

BRIEF DESCRIPTION OF THE DRAWINGS

In the following the invention will be described in greater detail by means of the accompanying drawings, in which.

DESCRIPTION OF THE PREFERRED EMBODIMENTS

With reference to FIGS. 1 to 11, an example is described concerning the structure and function of a switch-disconnector control unit according to the typical preferred embodiments.

Figure 1:
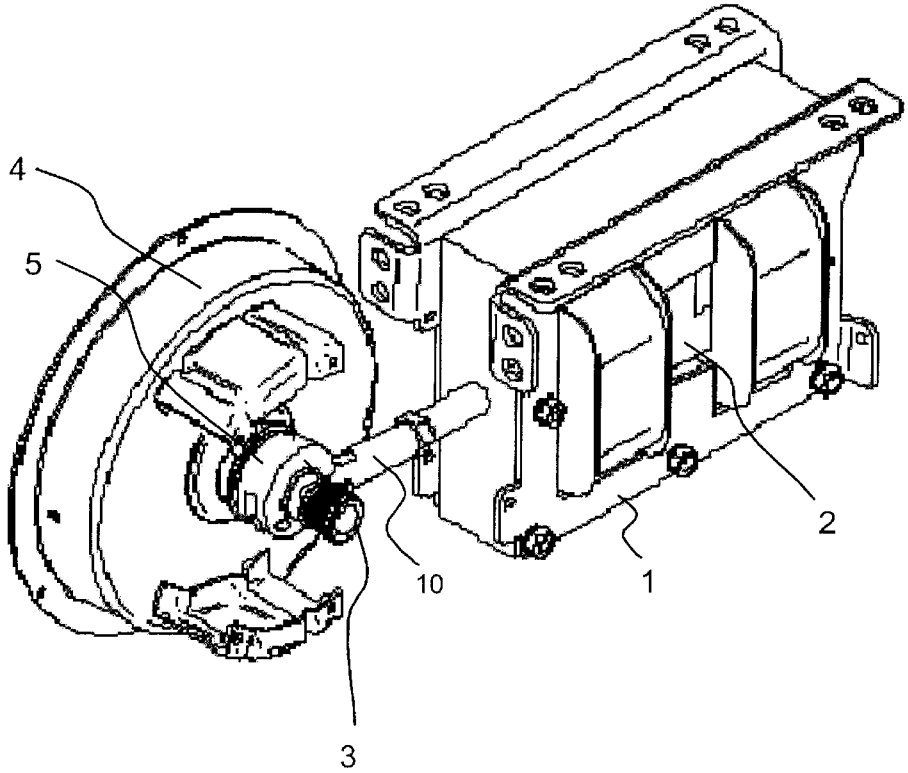
FIG. 1 is a perspective view showing a switch-disconnector control unit according to an embodiment of the invention.
Figure 2:
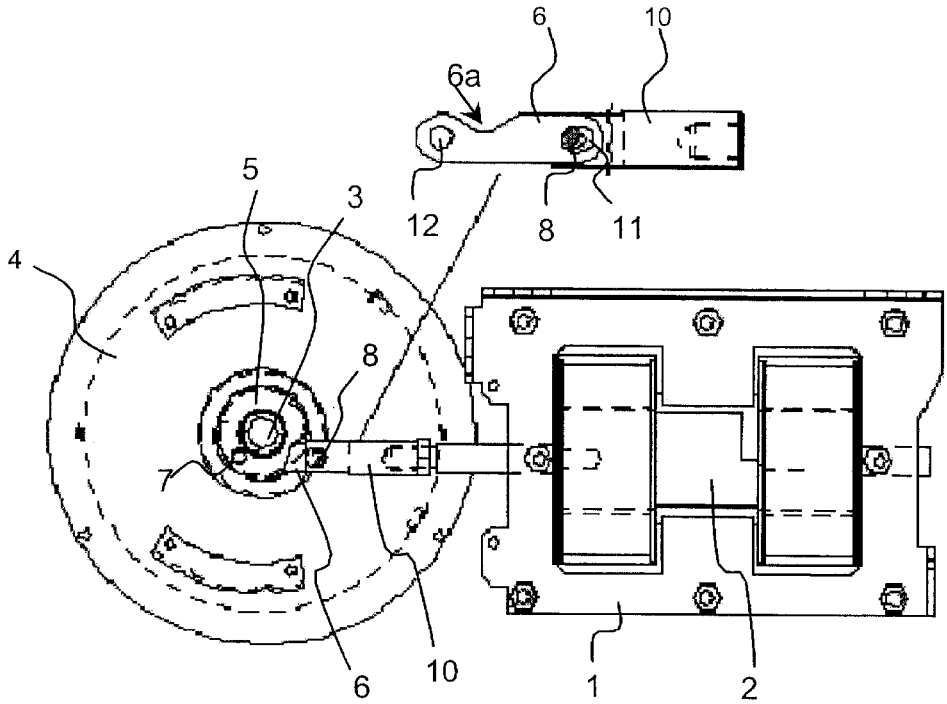
FIG. 2 shows the switch-disconnector according to FIG. 1 in the disconnector close position.

In accordance with FIG. 1, the switch-disconnector control unit comprises an actuator 1 including a movable control arm 10. The control arm 10 can naturally also be formed of one or more separate parts connected to one another. The actuator 1 is used to control a switch-disconnector control shaft 3, which in turn controls the contacts of the switch-disconnector through a spring actuator. The actuator 1 is an electromagnet 1, whose armature 2 is arranged to control the control arm 10. The electromagnet 1 operates as a double-acting electromagnet, meaning that the armature 2 of the electromagnet 1 is arranged to move linearly back and forth through the electric control. Thus, the electromagnet 1 allows switching the switch-disconnector between the disconnector open and disconnector close positions.

The control arm 10 is connected from the first end thereof to the control shaft 3 of the switch-disconnector and to the armature 2 of the actuator 1 from the second end thereof. The control shaft 3 is arranged to control the contacts of the switch-disconnector through a spring actuator 4. The spring actuator 4 comprises one or more springs, which are tightened using the motion provided by the armature 2 of the electromagnet 1. At the end point of the armature 2 motion, the spring of the spring actuator 4 trips and opens or closes the contacts of the switch-disconnector depending on the direction towards which the control shaft 3 is turned. In accordance with FIG. 5, the switch-disconnector control unit is tristable, thus comprising the positions: disconnector open (OPEN), disconnector close (CLOSE) and disconnector earthed (EARTHED). A crank can also be attached at the end of the control shaft 3, in which case the switch-disconnector is arranged to be controlled manually between the positions disconnector close (CLOSE) and disconnector open (OPEN) as well as between the positions disconnector open (OPEN) and disconnector earthed (EARTHED).

Figure 11:
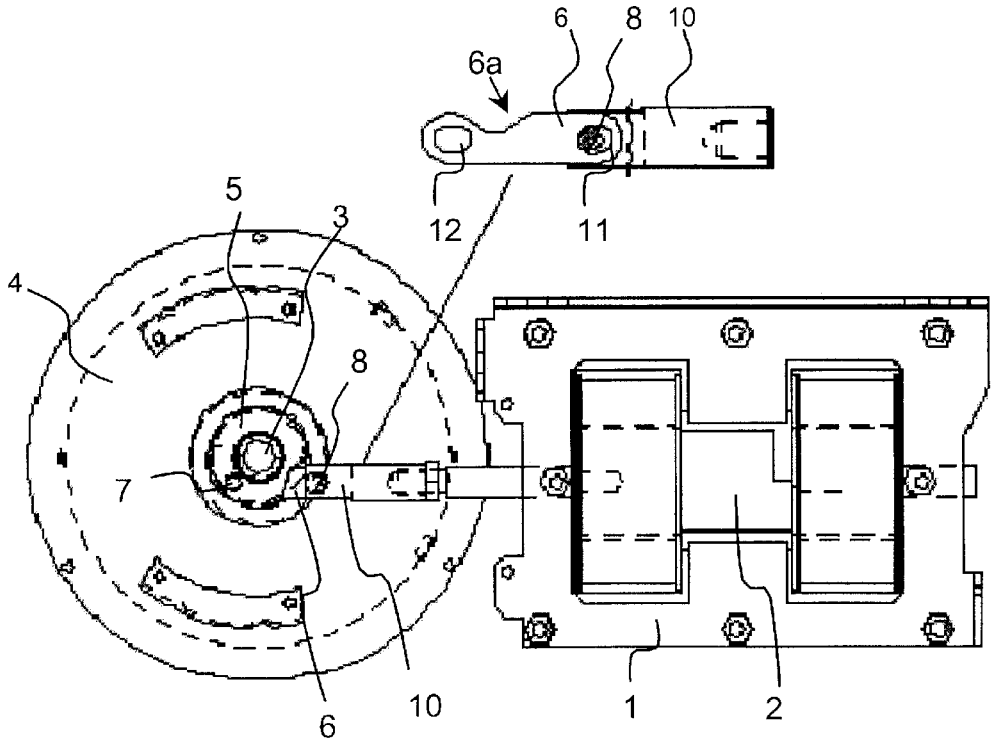
FIG. 11 shows a switch-disconnector according to another embodiment, in which both the openings in the connection element are oval, in the disconnector close position.

According to FIGS. 3 to 5 and FIGS. 6 to 8, the control arm 10 connected to the armature 2 of the electromagnet 1, or the actuator 1, comprises a connection element 6. The connection element 6 is preferably an elongated rod including elements 11, 12 at both ends for attaching the rod to the other structural parts in the switch-disconnector. A cavity 6*a* is preferably formed onto a side surface of the connection element. The cavity forms the space required by the control shaft 3, when the switch-disconnector is in the close position according to FIG. 6. The connection element 6 is jointedly connected from the first end thereof to the control shaft 3 through a control member 5. The control member 5 is a structural part connected to the control shaft 3, to which structural part the connection element 6 can be connected and thus cause a rotating control movement. The connection element 6 is jointedly connected to the control member 5 for example using a pin joint, in which case the control member 5 includes a pin 7 and an opening 12 at the end of the control member 5 side of the connection element 6. The pin 7 can be inserted through said opening. Consequently, the pin connection functions both as a connection and as a joint. The diameter of the opening 12 is either dimensioned accurately or broadly as regards the pin 7. If the opening 12 is broadly dimensioned, the shape of the opening 12 is preferably oval in the longitudinal direction of the connection element 6 as shown in FIG. 11.

From the first end the connection element 6 is jointedly connected to the control arm 10 of the actuator 1. An articulated joint at the second end of the connection element 6 is formed of an oval opening 11 parallel to the control shaft 3 formed at the end of the connection element 6 and of a pin 8 parallel to the control shaft 3 connected to the control arm 10 of the actuator 1 in the vicinity of the end of the connection element 6 side thereof, the pin 8 being arranged into the opening 11. The preferably oval opening 11 at the first end of the connection element 6 is oval in the longitudinal direction of the connection element 6 and dimensioned to form a clearance in the joint between the connection element 6 and the control arm 10 of the actuator 1. Naturally the shape of the opening 11 may deviate from the above described and be oval or round.

Figure 6:
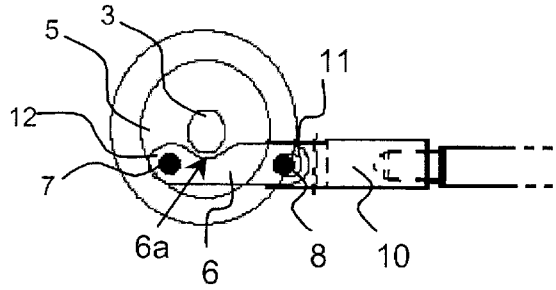
FIG. 6 shows the control member of the control shaft in the switch-disconnector according to FIG. 1 and the position of a connection element controlling the control shaft in the disconnector close position.
Figure 7:
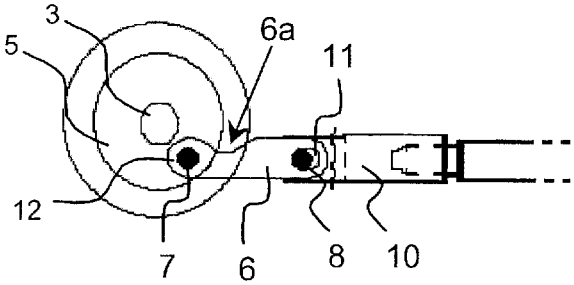
FIG. 7 shows the control member of the control shaft in the switch-disconnector according to FIG. 1 and the position of the connection element controlling the control shaft in the disconnector open position.
Figure 8:
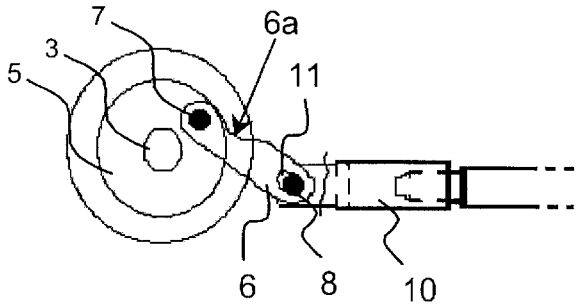
FIG. 8 shows the control member of the control shaft in the switch-disconnector according to FIG. 1 and the position of the connection element controlling the control shaft in the disconnector earthed position.
Figure 9:
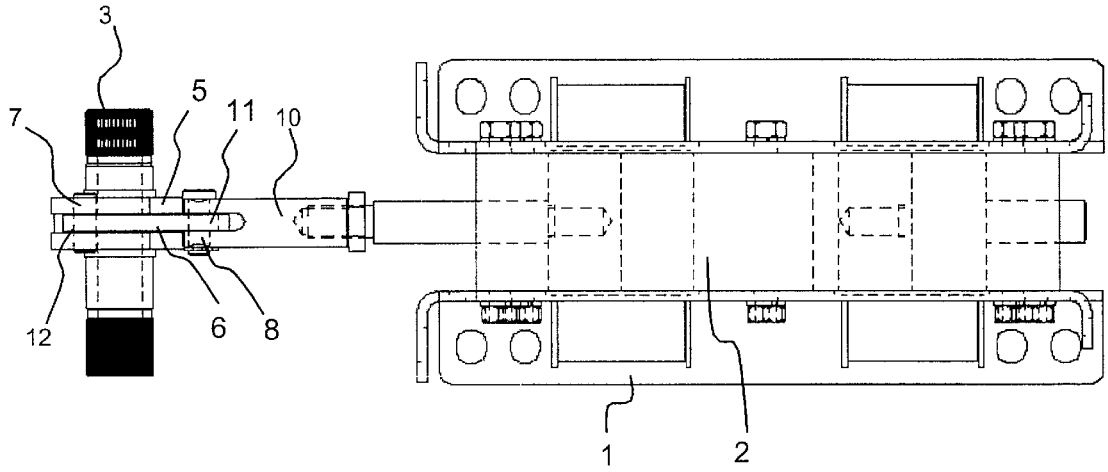
FIG. 9 shows the control shaft of the switch-disconnector control unit according to FIG. 1 from below in the disconnector close position.
Figure 10:
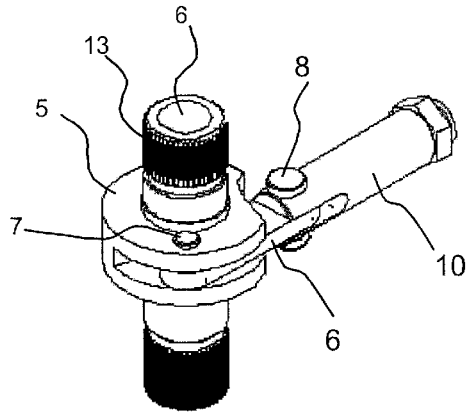
FIG. 10 is a perspective view showing the control mechanism of the switch-disconnector control unit according to FIG. 1.

FIGS. 6 to 8 show in more detail how the structure described above operates. The oval opening 11 at the first end of the connection element 6 connected to the control arm 10 moving the control shaft 3 of the disconnector forms a clearance in the joint between the connection element 6 and the control arm 10 of the actuator. Such a connecting way allowing a particular clearance in the joint results in that the disconnector control shaft 3 can be turned into such a position manually, in which the control arm 10 controlling the control shaft to which the connection element 6 is jointedly connected, can revolve over the dead centre thereof to the other side of the control shaft 3 and onwards to such a point, where the switch to the earthed onwards to such a point, where the switch to the earthed position occurs. When placed into the earthed position the actuator 1 cannot turn the control shaft 3 so that the disconnector is able to be directed back over the dead centre to the open position using the actuator 1, whereby remote-controlled malfunctions cannot occur. The switch between the earthed position and the open position can therefore be carried out only manually.

With reference to FIGS. 5 to 8 the structure between the switching positions of the disconnector operates as follows. FIGS. 2 to 6 show the disconnector in the close position (CLOSE). While directing the disconnector into the close position, the control arm 10 controlled by the actuator 1 is moved in the Figure towards the control shaft 3, whereby the control arm 10 turns the rotating control shaft 3 into the close position and the contacts of the disconnector are closed. Then, the pin 8 in the oval opening 11 of the connection element 6 has shifted to the end of the control shaft 3 side of the opening 11 owing to the thrust motion of the actuator.

Figure 3:
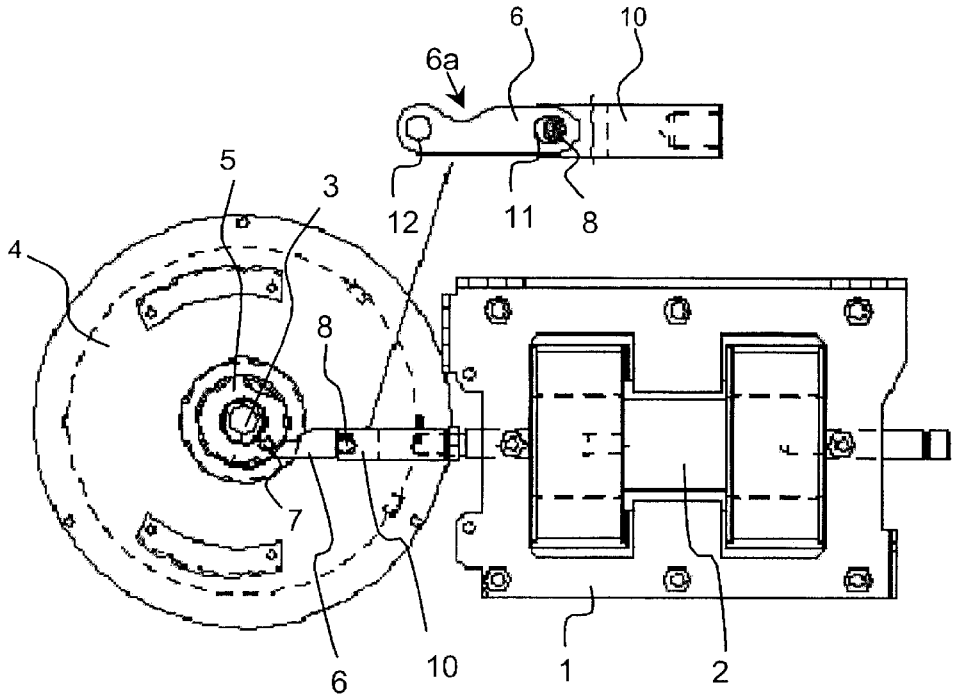
FIG. 3 shows the switch-disconnector according to FIG. 1 in the disconnector open position.

FIGS. 3 and 7 show the disconnector in the open position (OPEN). When directing the disconnector into the open position, the control arm 10 controlled by the actuator 1 is moved in the Figure from the control shaft 3 towards the actuator 1, whereby the control arm 10 turns the rotating control shaft 3 into the open position and the contacts of the disconnector are opened. Then, the pin 8 in the oval opening 11 of the connection element 6 has shifted to the end of the control shaft 3 side of the opening 11 owing to the pulling motion of the actuator.

Figure 4:
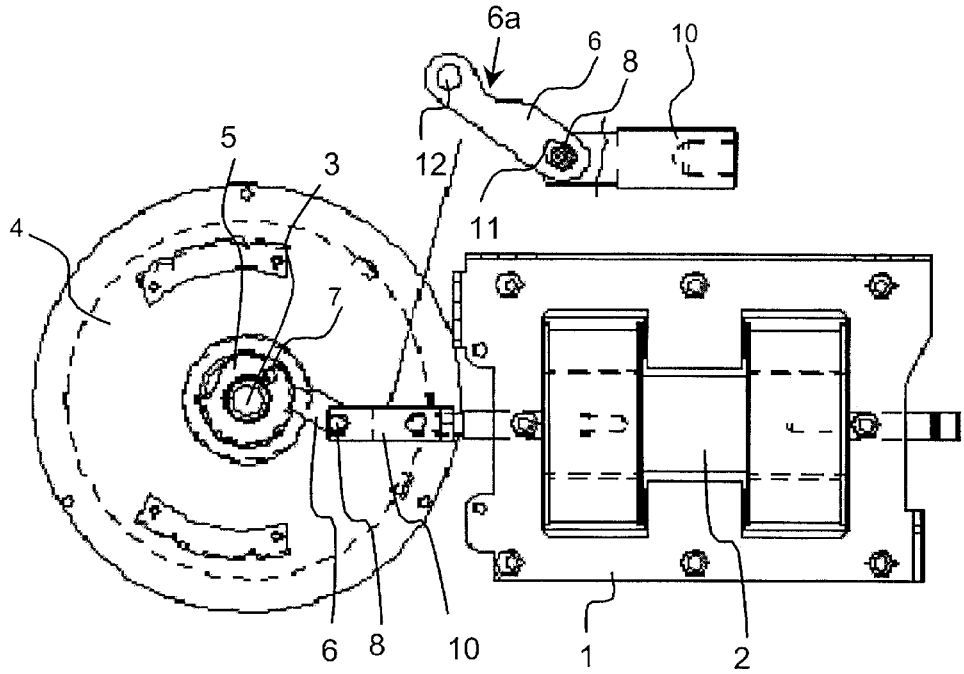
FIG. 4 shows the switch-disconnector according to FIG. 1 in the disconnector earthed position.
Figure 5:
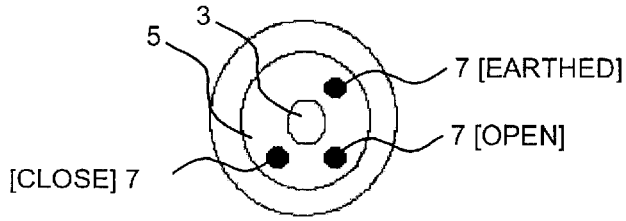
FIG. 5 shows the position of a control member of the control shaft in the switch-disconnector control unit according to FIG. 1 in the different positions of the disconnector.

FIGS. 4 and 8 show a disconnector in the earthed position (EARTHED). The disconnector can be directed to this position only manually from the crank connected to the control shaft 3. The starting position is then the open position (OPEN), and the pin 8 in the oval opening 11 of the connection element 6 is then shifted to the end of the actuator 1 side of the opening 11. Thus, directing the disconnector manually from the crank connected to the control shaft 3, the disconnector is turned from the control shaft 3 to the earthed position (EARTHED). To successfully perform this motion requires that the connection element 6 can move in the direction of the actuator 1, which is made possible by shaping the opening 11 into an oval form or by making said opening large in some other way. The connection element 6 can also turn in relation to the joint formed by the pin 8, in which case the end on the control shaft 3 side of the connection element rises upwards and the control shaft 3 directs the disconnector into the earthed position (EARTHED). The space, or clearance, provided at the end of the connection element arranged by means of the oval shape of the opening 11 enables the control member 5 to revolve over the dead centre thereof to the other side of the control shaft 3 and onwards to such a point where the switch to the earthed position occurs. When placed into the earthed position the actuator 1 is not capable of turning the control shaft 3 so that the actuator 1 can direct the disconnector back over the dead centre into the open position, but the switch into the open position must be made manually.

The mechanism described above is arranged to operate in such a manner that the armature 2 of the electromagnet 1, in the first end point thereof, corresponds to the close position of the switch-disconnector. Correspondingly, the armature 2 of the electromagnet 1, in the second extreme position thereof, corresponds to the open position of the switch-disconnector. The switch between the open position and the close position or vice versa may occur either using the electric control of the electromagnet 1 or manually by revolving the control shaft 3 with the crank, in which case the control shaft of the electromagnet 1 moves without retarding the motion as the magnet remains de-energized, or is disconnected.

It is understandable that the above description and the Figures associated therewith are merely intended to illustrate the present invention. The invention is therefore not restricted only to the above or to the embodiment defined in the claims, but a number of different variations and modifications of the invention will be apparent for those skilled in the art that can be carried out within the scope of the inventive idea defined in the appended claims.

What is claimed is:

1. A switch-disconnector control unit comprising:

an actuator including a moving control arm, and a spring actuator including a control shaft, whereby the control arm is connected from the first end thereof to the actuator and from the second end thereof to the control shaft of the spring actuator, whereby the control shaft is arranged to control the contacts of the switch-disconnector using the spring actuator, wherein the control arm comprises a connection element, which connection element is jointedly connected from the first end thereof to the control shaft through a control member, and from the second end thereof the connection element is jointedly connected to the control member of the actuator, and an articulated joint at the second end of the connection element is substantially formed of an opening parallel to the control shaft in the vicinity of the end of the connection element and of a pin parallel to the control shaft connected to the control arm of the actuator substantially in the vicinity of the end of the connection element side thereof, the pin being arranged to the opening, which is dimensioned to be large in relation to the pin.

2. A switch-disconnector as claimed in claim 1, wherein the opening at the second end of the connection element is oval in the longitudinal direction of the connection element.

3. A switch-disconnector as claimed in claim 1, wherein an articulated joint at the first end of the connection element is substantially formed of an opening in the vicinity of the end of the connection element and of a pin parallel to the control shaft connected to the control member of the control shaft in the spring actuator, the pin being arranged into the opening, which is dimensioned to be large in relation to the pin.

4. A switch-disconnector as claimed in claim 3, wherein the opening at the first end of the connection element is oval in the longitudinal direction of the connection element.

5. A switch-disconnector as claimed in claim 1, wherein the actuator is an electromagnet, the armature of which is arranged to control the control arm.

6. A switch-disconnector as claimed in claim 5, wherein the electromagnet is a double-acting electromagnet, whereby the armature of the electromagnet is arranged to move linearly back and forth by means of the electric control.

7. A switch-disconnector as claimed in claim 1, wherein the control shaft is arranged to control the contacts of the switch-disconnector through the spring actuator comprising one or more springs to be tightened using the motion of the armature of the electromagnet, whereby the spring of the spring actuator trips substantially at the end point of the armature motion, thus opening and closing the contacts of the switch-disconnector.

8. A switch-disconnector as claimed in claim 7, wherein the spring actuator is tristable and comprises the positions: disconnector open (OPEN), disconnector close (CLOSE) and disconnector earthed (EARTHED).

9. A switch-disconnector as claimed in claim 8, wherein the electromagnet is arranged to control the switch-disconnector between the positions disconnector close (CLOSE) and disconnector open (OPEN).

10. A switch-disconnector as claimed in claim 5, wherein the control shaft is arranged to control the contacts of the switch-disconnector through the spring actuator comprising one or more springs to be tightened using the motion of the armature of the electromagnet, whereby the spring of the spring actuator trips substantially at the end point of the armature motion, thus opening and closing the contacts of the switch-disconnector.

11. A switch-disconnector as claimed in claim 10, wherein the spring actuator is tristable and comprises the positions: disconnector open (OPEN), disconnector close (CLOSE) and disconnector earthed (EARTHED).

12. A switch-disconnector as claimed in claim 11, wherein the electromagnet is arranged to control the switch-disconnector between the positions disconnector close (CLOSE) and disconnector open (OPEN).

13. A switch-disconnector as claimed in claim 1, wherein the control shaft is arranged to receive a crank to be connected to the end of the control shaft, whereby the switch-disconnector is arranged to be controlled manually between the positions disconnector close (CLOSE) and disconnector (OPEN) as well as between the positions disconnector open (OPEN) and disconnector earthed (EARTHED).

* * * * *